US010522888B2

(12) United States Patent
Ernst et al.

(10) Patent No.: US 10,522,888 B2
(45) Date of Patent: Dec. 31, 2019

(54) MICROWAVE BRANCHING SWITCH

(71) Applicant: European Space Agency, Paris (FR)

(72) Inventors: Christoph Ernst, Voorhout (NL); Petronilo Martin Iglesias, The Hague (NL); Uwe Rosenberg, Osterholz-Scharmbeck (DE)

(73) Assignee: EUROPEAN SPACE AGENCY, Paris (FR)

( * ) Notice: Subject to any disclaimer, the term of this patent is extended or adjusted under 35 U.S.C. 154(b) by 26 days.

(21) Appl. No.: 15/749,390

(22) PCT Filed: Aug. 3, 2015

(86) PCT No.: PCT/EP2015/067815
§ 371 (c)(1),
(2) Date: Jan. 31, 2018

(87) PCT Pub. No.: WO2017/020948
PCT Pub. Date: Feb. 9, 2017

(65) Prior Publication Data

US 2018/0226705 A1 Aug. 9, 2018

(51) Int. Cl.
*H01P 1/12* (2006.01)
*H01P 5/19* (2006.01)
*H01P 1/213* (2006.01)

(52) U.S. Cl.
CPC ..... *H01P 1/122* (2013.01); *H01P 1/125* (2013.01); *H01P 1/213* (2013.01); *H01P 5/19* (2013.01)

(58) Field of Classification Search
CPC ..... H01P 1/122; H01P 1/213
(Continued)

(56) References Cited

U.S. PATENT DOCUMENTS 2,814,782 A 11/1957 Zaleski
2,912,694 A * 11/1959 Phillips, Jr. ..... G01S 1/02 333/106

(Continued)

FOREIGN PATENT DOCUMENTS

EP 0809317 A1 11/1997
EP 1753071 A1 2/2007
JP H0514003 A 1/1993

OTHER PUBLICATIONS

International Search Report and Written Opinion of related PCT Application No. PCT/EP2015/067815 dated Jun. 2, 2016; 20 pages.

*Primary Examiner* — Dean O Takaoka
(74) *Attorney, Agent, or Firm* — Procopio, Cory, Hargreaves & Savitch LLP

(57) ABSTRACT

A microwave branching switch for selectively interconnecting terminals of a plurality of microwave transmission lines, involving microwave transmission lines with a terminal; a housing in which the terminals are arranged; a switching portion with a junction portion for selectively interconnecting terminals of the microwave transmission lines through selective interconnection. The switching portion is switchable between a first position and a second position; wherein the switching portion with the junction portion is dimensioned and positioned inside the housing in dependence of an arrangement of the microwave transmission lines such that the junction portion interconnects a first group of terminals when the switching portion is in the first position and interconnects a second group of terminals when the switching portion is in the second position. The first and second groups of terminals differ in at least one terminal and the first group of terminals involves at least three terminals.

14 Claims, 12 Drawing Sheets

(58) Field of Classification Search
USPC ..... 333/106, 108
See application file for complete search history.

(56) References Cited

U.S. PATENT DOCUMENTS

| | | | | | |
|---|---|---|---|---|---|
| 3,112,459 | A | | 11/1963 | Blass et al. | |
| 4,201,963 | A | | 5/1980 | Welti | |
| 4,242,652 | A | | 12/1980 | Shishido et al. | |
| 4,649,355 | A | * | 3/1987 | Ullman | H01P 1/125 333/106 |
| 4,761,622 | A | * | 8/1988 | Cracknell | H01P 1/122 333/106 |
| 4,806,887 | A | | 2/1989 | Au-Yeung | |
| 4,908,589 | A | | 3/1990 | Basil, Jr. et al. | |
| 5,206,610 | A | * | 4/1993 | Nelson | H01P 1/122 333/106 |
| 6,448,869 | B1 | * | 9/2002 | Kich | H01P 1/122 333/106 |
| 6,667,671 | B1 | | 12/2003 | Speldrich et al. | |
| 8,587,386 | B2 | * | 11/2013 | Hauff | H01P 1/122 333/106 |
| 2010/0134202 | A1 | | 6/2010 | Leinonen et al. | |

* cited by examiner

MICROWAVE BRANCHING SWITCH

CROSS-REFERENCE TO RELATED APPLICATIONS

This application is a U.S. National Stage entry of PCT Application No: PCT/EP2015/067815 filed Aug. 3, 2015, the contents of which are incorporated herein by reference.

TECHNICAL FIELD

This application relates to a microwave branching switch for selectively interconnecting terminals of a plurality of microwave transmission lines, comprising at least a first microwave transmission line with a first terminal, a second microwave transmission line with a second terminal, a third microwave transmission line with a third terminal and a fourth microwave transmission line with a fourth terminal; a housing in which the terminals of the plurality of microwave transmission lines are arranged; and a switching portion with at least a first junction portion for selectively interconnecting terminals of the plurality of microwave transmission lines by selectively interconnecting the respective microwave transmission lines, wherein the switching portion is switchable between at least a first position and a second position.

BACKGROUND

Waveguide switches are key hardware used for redundancy switching and signal routing, thanks to their outstanding reliability and very high power handling capacity.

U.S. Pat. No. 2,814,782 describes a waveguide switch comprising first and second rectangular waveguides joined to form a first double mitered ninety degree E-plane bend, the mean distance between miters being approximately equal to one quarter of a guide wavelength, a third rectangular waveguide collinear with said second waveguide and extending in the opposite direction from said bend, means for rotating the outer section of said bend about its midpoint whereby when rotated through ninety degrees, a second bend comprising said first and third waveguides and said section is formed, and dielectric filled slots one quarter wavelength deep formed in opposite edges of said outer section.

U.S. Pat. No. 4,806,887 describes a waveguide R-switch having transformers in one or more of its three waveguide paths. The presence of the transformers allows the R-switch to be constructed of a smaller size than previous R-switches with curved outer paths.

U.S. Pat. No. 6,667,671 B1 describes a waveguide switch having a stator and an electrically conducting movable element, the stator having waveguide paths between waveguide terminal pairs, each path being switchable to conducting or nonconducting with the help of the movable element for high-frequency waves. The movable element is designed as a septum in a gap in the stator and extends in the waveguide path, which is switched to nonconducting, in parallel to its E plane. This divides the waveguide path into two partial waveguides, which run in parallel with one another and, in comparison with the switched-to-conducting state of the waveguide path, have smaller cut-off wavelengths.

U.S. Pat. No. 4,242,652 describes a waveguide switch having four RF ports in coplanar relationship and incorporating four waveguide transmission lines in a single rotating mechanism on two levels, the rotating mechanism being driven by an electromagnetic stepper motor or the like.

U.S. Pat. No. 4,908,589 describes a dielectrically loaded waveguide switch including first and second dielectrically loaded waveguides selectively connected by a switch. The switch includes a third dielectrically loaded waveguide mounted for communication with said first and second waveguides upon switch actuation.

FIG. 13 shows an example of a conventional switch 2. The switch 2 enables selective connection between pairs of four transmission lines 11-14 which allow for propagation of electromagnetic waves. The switch 2 comprises a rotatable switching portion 3 for a pairwise connection of the four transmission lines 11-14. In the first position of the switching portion 3 which is illustrated in FIG. 13, the first transmission line 11 is connected with the fourth transmission line 14 but disconnected from the second transmission line 12 and the third transmission line 13 which are connected with each other. Upon rotating the switching portion 3 by 90 degrees in a clockwise direction, the first transmission line 11 is connected to the second transmission line 12 and the third transmission line 13 is connected to the fourth transmission line 14. The switching portion portion 3 can be rotated further in steps of 90 degrees to connect any one of the four transmission lines 11-14 with one of its adjacent transmission lines 11-14 and to connect the remaining two transmission lines at the same time.

Switches 2 are frequently applied in multiplexer configurations for changing the routing of the input signal, as is illustrated in FIG. 14A. The exemplary multiplexer 4 comprises three signal ports 110, wherein the signal port 110 on the left hand side is used as an input port and the two signal ports 110 on the right hand side are used as output ports. The multiplexer 4 further comprises four signal filters 120*a*-120*d* of which signal filters 120*a* and 120*c* pass the frequency range ch1, the signal filter 120*b* passes the frequency range ch2 and the signal filter 120*d* passes the frequency range ch2*a*. Additionally, three switches 2*a*-2*c* are provided in the multiplexer for changing the signal routing along the transmission lines 150 connecting the components of the multiplexer 4. Furthermore, the multiplexer 4 may comprise branching junctions 130 for interconnecting three transmission lines 150.

By switching all of the switches 2*a*-2*c* from a first state (not shown) of the multiplexer 4 to a second state of the multiplexer 4 (as shown in FIG. 14A), the combined frequency bandwidth of the output signal can be changed from ch1+ch2 (first state) to ch1+ch2*a*. This situation is schematically illustrated in FIG. 14B where the top scheme shows the frequency range of the output signal when the multiplexer 4 of FIG. 14A is in the first state and the bottom scheme shows the frequency range of the output signal when the multiplexer 4 of FIG. 14A is in the second state.

FIG. 15 illustrates another exemplary multiplexer configuration with four input ports 110, a first output port 111 and a second output port 112. The purpose of this multiplexer 4 is to provide signals at the first and second output ports 111, 112 which both contain the frequency range ch1 in any case and might additionally contain the frequency ranges ch2 and/or ch3. For this purpose, two switches 2*a*, 2*b* and six signal filters 120 are provided in the multiplexer 4. The switch 2*a* can allocate the frequency range ch2 either to the first output port 111 or to the second output port 112. The switch 2*b* can likewise allocate the frequency range ch3 either to the first output port 111 or to the second output port 112, independently of the allocation of the frequency range ch2.

In the examples shown in FIGS. 14-15, a specific signal filter 120 can be connected to a single input port and a single output port at the same time while still providing the possibility to change the connection configuration. This results in a large number of necessary signal filters depending on the desired compositions of the output signals.

Thus, there is a need for a building block allowing for an increased operational flexibility of switchable electronic circuits. Further, there is a need for a building block allowing for a decreased complexity of switchable electronic circuits.

SUMMARY

In view of these needs, the present document proposes a microwave branching switch for selectively interconnecting terminals of a plurality of microwave transmission lines having the features of claim 1. The dependent claims refer to preferred embodiments of the invention.

An aspect of the disclosure relates to a microwave branching switch for selectively interconnecting terminals of a plurality of microwave transmission lines, comprising at least a first microwave transmission line with a first terminal, a second microwave transmission line with a second terminal, a third microwave transmission line with a third terminal and a fourth microwave transmission line with a fourth terminal; a housing in which the terminals of the plurality of microwave transmission lines are arranged; a switching portion with at least a first junction portion for selectively interconnecting terminals of the plurality of microwave transmission lines by selectively interconnecting the respective microwave transmission lines, wherein the switching portion is switchable between at least a first position and a second position; wherein the switching portion with at least the first junction portion is dimensioned and positioned inside the housing in dependence of an arrangement of the plurality of microwave transmission lines such that the first junction portion interconnects a first group of terminals of the plurality of microwave transmission lines when the switching portion is in the first position and interconnects a second group of terminals of the plurality of microwave transmission lines when the switching portion is in the second position, wherein the first group of terminals and the second group of terminals differ in at least one terminal of the plurality of microwave transmission lines and the first group of terminals and/or the second group of terminals comprise the first terminal, the third terminal and the fourth terminal.

Simply put, there exists at least one position of the switching portion for which three or more terminals are interconnected such that microwaves entering the microwave branching switch through one terminal leave the microwave branching switch through two other terminals or that microwaves entering the microwave branching switch through two terminals at the same time leave the microwave branching switch through one other terminal. Microwaves are electromagnetic waves with frequencies ranging between 300 MHz and 300 GHz.

The second terminal may be disconnected from the first junction portion when the switching portion is in the first position; and either the first terminal or the third terminal or the fourth terminal may be disconnected from the first junction portion when the switching portion is in the second position.

Thus, it is possible to use the microwave branching switch not only to transmit and route microwave signals but also to selectively block microwave signals within a circuit configuration.

The terminal disconnected from the first junction portion may be connected to an impedance, a load or a short circuit.

Thereby the disconnected terminal and the corresponding microwave transmission line are effectively isolated from the other terminals and microwave transmission lines. The impedance, load or short circuit may be a part of the switching portion. In case this part is partly filled with an absorbing material, it may act as a load (i.e. a matched termination).

The first junction portion may be T-shaped or Y-shaped.

If exactly three terminals are to be switchably connected, T- or Y-shaped junction portions facilitate the manufacture of a simply structured switch with short transmission paths.

The plurality of microwave transmission lines may be a plurality of hollow waveguides or a plurality of coaxial lines.

Hollow waveguides may be formed as straight and rigid metal tubes with a rectangular or circular cross section. On the other hand, a coaxial line comprises an outer conductor and an inner conductor positioned inside the outer conductor and may be filled with a dielectric.

The switching portion may be a rotor; the terminals of the plurality of microwave transmission lines may be arranged evenly spaced in the housing; and the rotor may be switched between the first position and the second position by rotating the rotor by a predetermined angle.

An even spacing of the terminals in the housing is not required but advantageous for simple manufacturing and replaceability of the switch. A rotor is a mechanical possibility for switching between positions. The predetermined angle by which the rotor is rotated from one position to the next position depends on the arrangement of the terminals in the housing and on the arrangement of the transmission lines in the switch and may or may not be equal to the angular distance between two adjacent terminals.

The rotor may be switchable between the second position and a third position and between the third position and a fourth position, wherein the rotor may be switched from the first position over the second position and the third position to the fourth position by rotating the rotor in a clockwise direction in steps of 90 degrees.

There may also be more than four positions of the rotor.

The switching portion may comprise a second junction portion for selectively interconnecting terminals of the plurality of microwave transmission lines, wherein the switching portion with the first junction portion and the second junction portion may be dimensioned and positioned inside the housing in dependence of the arrangement of the plurality of microwave transmission lines such that the first junction portion interconnects the first group of terminals of the plurality of microwave transmission lines and the second junction portion interconnects a third group of terminals of the plurality of microwave transmission lines when the switching portion is in the first position, and the first group of terminals and the third group of terminals may be disjoint groups of terminals.

In two disjoint groups of terminals, a terminal belonging to one group cannot belong to the other group at the same time. With at least two separate junction portions within the same switch, at least two transmission pathways that are isolated from each other can be provided. When such a switch is used as a switchable element in a circuit configuration, the number of switches required for reconfiguring the connections within the circuit can be greatly reduced.

The first group of terminals may comprise four terminals of the plurality of microwave transmission lines, the third group of terminals may comprise four terminals of the plurality of microwave transmission lines, the first junction portion may interconnect the four terminals of the first group of terminals when the switching portion is in the first position, the second junction portion may interconnect the four terminals of the third group of terminals when the switching portion is in the first position, and the switching portion is switched between two positions of a total of eight positions by rotating the switching portion in a clockwise direction in steps of 45 degrees.

This structure is advantageous for guiding signals from three input terminals to one output terminal, with the possibility to change the allocations according to varying transmission services demands.

Another aspect of the disclosure relates to a multiplexer for combining and/or separating electromagnetic signals, comprising a plurality of signal ports for inputting electromagnetic signals into the multiplexer or outputting electromagnetic signals from the multiplexer; a plurality of signal filters for filtering electromagnetic signals; one or more branching junctions for combining electromagnetic signals or for distributing an electromagnetic signal; wherein each signal filter is connectable to a signal port of the plurality of signal ports and to a branching junction of the one or more branching junctions or connectable to two branching junctions of the one or more of branching junctions; the plurality of signal ports comprising a first common signal port that is connectable to a branching junction of the one or more branching junctions; and the one or more branching junctions comprising the microwave branching switch for selectively interconnecting signal filters of the plurality of signal filters and the first common signal port.

The multiplexer has a single input port and multiple output ports, or multiple input ports and a single output port, or multiple input ports and multiple output ports. Preferably, the signal filters are formed as bandpass filters which transmit signals of predetermined frequency bandwidths. They can also be realized as other types of filters. A branching junction is a connection point in the transmission line network of the multiplexer where at least three transmission lines are interconnected. A signal arriving at this point from a transmission line is directed (distributed) to the other transmission lines connected at this point. Signals arriving at this point from multiple transmission lines connected at this point are directed to the other transmission lines connected at this point as a single (combined) signal. A connectable component of the multiplexer is a component that is connected to another component of the multiplexer in a first state of the multiplexer but is disconnected from the other component in a second state of the multiplexer. That is, a connectable component need not be connected to the multiplexer configuration all the time. Switching between the first state and the second state is performed by operating a switch (for example, a microwave branching switch as described above or a conventional switch) of the multiplexer. The multiplexer may be a manifold multiplexer.

Since the microwave branching switch combines branching and switching functions within a single functional component, it enables a flexible but still compact configuration of the multiplexer. Furthermore, this solution is scalable, providing a large technical gain with limited technical change.

With a multiplexer that is reconfigurable in this manner, changing the service or capacity demands is accommodated by a flexible re-allocation of transmission channels. For example, in a multiplexer comprising four channels and a microwave branching switch, three of the four channels can be multiplexed in different ways depending on the setting of the microwave branching switch. Another advantage is a less complex realization of a multiplexer with more than one output port, allowing for a flexible allocation of specific channels to either one of the output ports, which is useful for example in the case of satellite based communications systems for serving different service areas with a varying transmission capacity.

The multiplexer also enables the realization of an OMUX providing several output ports for serving different service areas, wherein some of the multiplexer channels are combined and served at the first output port while the remaining channels are served at the second output port. The use of microwave branching switches as manifold T-junctions in the multiplexer facilitates a flexible assignment of dedicated channels to the first or second output port. Thus, the transmission capacity, i.e. the number of channels dedicated to an output port, can be changed between the two output ports, for example to accommodate flexible re-allocations for different services.

Furthermore, the microwave branching switch can be used in reconfigurable multiplexers where overlapping frequency bands or different frequency bands need to be switched.

Also, waveguide circuitries comprising the microwave branching switch can be switched so as to compensate for contiguous and non-contiguous channel allocations. An example is a tunable filter implementation where channel frequencies can be arbitrarily close or far-distance.

Due to the dual functionality of splitting and switching, the inventive multiplexer also results in cost savings, for instance in telecom services for flexible payloads, in reduced integration effort, during manufacturing, or maintenance; reconfigurable multiplexer designs using the microwave branching switch may yield a reduction of necessary OMUX equipment compared with state-of-the-art implementations and thus a reduction of interconnections and switch hardware and a reduction of mass in satellite applications due to the reduced complexity.

Finally, the inventive multiplexer enables a more compact realization of the functionalities of conventional multiplexers.

Further application areas are multibeam and broadcast missions, navigation applications, antenna systems or radio applications.

The plurality of signal ports may comprise a second common signal port that is connectable to a branching junction of the one or more branching junctions; the microwave branching switch may interconnect a first group of signal filters of the plurality of signal filters and the first common signal port when the switching portion of the microwave branching switch is in the first position and the microwave branching switch may interconnect a second group of signal filters of the plurality of signal filters and the second common port when the switching portion of the microwave branching switch is in the second position.

Thereby, the structure of a switchable multiplexer with more than one common port, for example with two output ports, is simplified.

The multiplexer may further comprise a compensation circuit that is connectable to a terminal of the plurality of microwave transmission lines of the microwave branching switch for providing a predetermined impedance at the terminal.

A compensation circuit is a circuit which emulates an impedance with a predefined characteristic over a frequency range of interest. The compensation circuit may be realized as one or more coupled resonators. Thus, the compensation circuit is considered in case of changing contiguous to non-contiguous channel schemes to compensate for the impedance of the missing adjacent filter in the non-contiguous channel allocations.

Each junction portion in the multiplexer may be directly connected to one signal filter of the plurality of signal filters for interconnecting the one signal filter and either the first common signal port or the second common signal port.

If a junction portion is directly connected to a signal filter, it means that in addition to the junction portion being connected to the signal filter, there is no branching junction (unswitchable or switchable in the form of another junction portion) set between the junction portion and the signal filter.

Thereby, the allocation of a specific signal filter to the signal ports can be changed independently of the allocations of other signal filters to the signal ports.

Alternatively, at least one junction portion in the multiplexer may be directly connected to at least two signal filters of the plurality of signal filters for simultaneously interconnecting the at least two signal filters and either the first common signal port or the second common signal port.

Thus, the frequency allocation of two signal filters to the signal ports can be changed in a simple manner.

Another aspect of the disclosure relates to a switchable power divider for a beam forming network, comprising at least three antenna beams; a common port; and the microwave branching switch for selectively interconnecting antenna beams of the at least three antenna beams and the common port, wherein the microwave transmission lines of the microwave branching switch differ in size for providing different power levels at the terminals of the microwave branching switch.

Thereby, an active beam forming is possible and different beams can be combined or severed. The difference in size can be realized by providing microwave transmission lines with different cross sections, for example. The output signal of the switchable power divider is preferably frequency-independent.

DETAILED DESCRIPTION

In the following, the invention will be described in an exemplary manner with reference to the appended figures. Identical elements in the figures may be indicated by identical reference numbers, and repeated description thereof may be omitted.

Figure 1A:
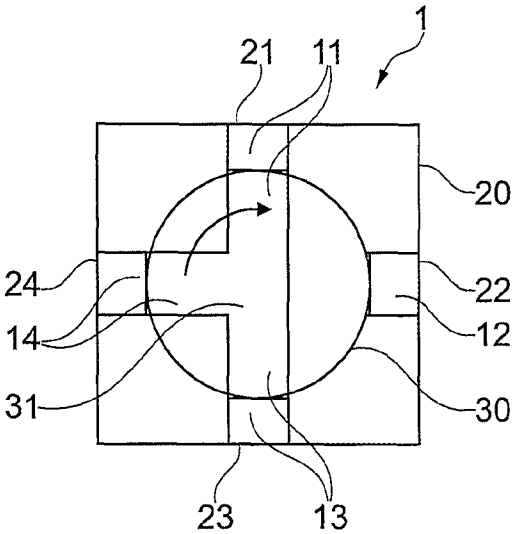
FIGS. 1A-1B schematically illustrate an example of a microwave branching switch according to embodiments of the disclosure in the first position.
Figure 1B:
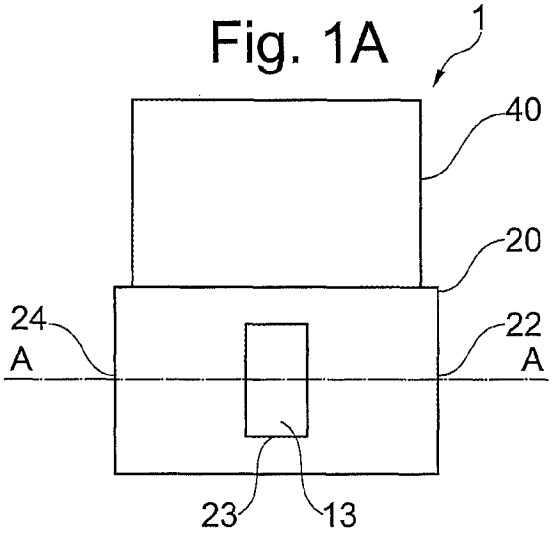

FIGS. 1A/1B illustrate an example of a microwave branching switch 1. FIG. 1A is a sectional view along the line A-A in FIG. 1B. The first to fourth microwave transmission lines 11-14 in this exemplary microwave branching switch 1 are waveguides. The waveguides may be straight, rigid tubes having a rectangular cross section. However, the waveguides might also be ridge waveguides or dielectric waveguides (waveguides filled with a dielectric). The transmission lines 11-14 are preferably but not necessarily positioned on the same level in the housing 20. Their positioning inside the housing 20 can also be inclined. The connection to transmission lines 150 outside of the housing 20 is achieved by terminals 21-24 in the housing 20. Each transmission line 11-14 is associated with a terminal 21-24 in the housing such that terminal 21 is positioned at an end portion of transmission line 11, terminal 22 is positioned at an end portion of transmission line 12, terminal 23 is positioned at an end portion of transmission line 13 and terminal 24 is positioned at an end portion of transmission line 14.

The microwave branching switch 1 further comprises a switching portion 30 in the form of a circular rotor that is rotatable around its center point by operating the actuator 40. The boundary of the switching portion 30 divides a transmission line 11; 12; 13; 14 into two parts (in FIG. 1A the transmission lines 11, 13, 14) or terminates a transmission line 11; 12; 13; 14 (in FIG. 1A the transmission line 12). Three of the four transmission lines 11-14 are connected at the center of the switching portion 30 while the fourth transmission line 11; 12; 13; 14 is disconnected from the three connected transmission lines. The disconnected transmission line is connected to a short circuit, a load or a predetermined impedance 33 which is part of the switching portion. The parts of the transmission lines 11-14 that are connected inside the switching portion 30 are termed first junction portion 31. The first junction portion 31 has a T-shape in the example of the switch 1 illustrated in FIG. 1A.

Which ones of the transmission lines 11-14 are connected in the switching portion 30 and which one is disconnected from the connected transmission lines is defined by the current position of the switching portion 30. FIG. 1A shows a microwave branching switch 1 with the switching portion 30 set in the first position. The switch 1 can be switched from the first position into the second position by rotating the switching portion 30 in a clockwise direction by 90 degrees (indicated by the arrow). The available positions for this exemplary switch 1 are described in more detail in the context of FIG. 4.

Figure 2A:
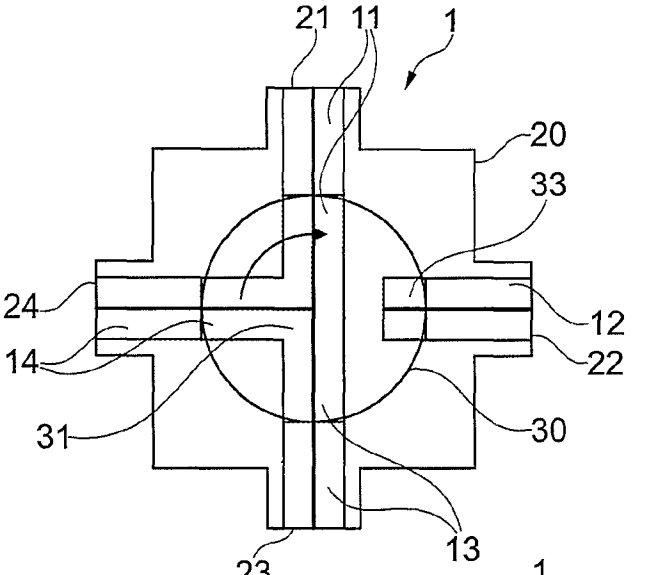
FIGS. 2A-2B schematically illustrate another example of a microwave branching switch according to embodiments of the disclosure in the first position.
Figure 2B:
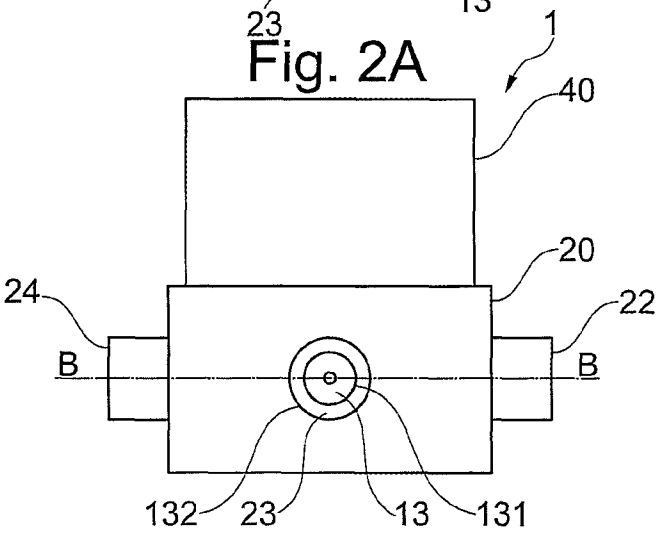

FIGS. 2A/2B illustrate another example of a microwave branching switch 1. FIG. 2A is a sectional view along the line B-B in FIG. 2B. The microwave branching switch 1 is a coaxial switch, meaning the first to fourth microwave transmission lines 11-14 are coaxial lines filled with a dielectric and comprising inner conductors 111, 121, 131, 141 and outer conductors 112, 122, 132, 142. The microwave branching switch 1 of FIGS. 2A/2B is similar to the microwave branching switch 1 of FIGS. 1A/1B. In particular, the switch 1 in FIG. 2A is also in the first position, with the second transmission line 12 disconnected from the first, third and fourth transmission lines 11, 13 and 14. In the example of FIG. 2A, a part of the disconnected transmission line 12 remains inside the switching portion 30 and may be terminated into a short circuit, a load or a predetermined impedance 33. Such a termination of the disconnected transmission line 12 might be realized also in the following examples showing a microwave branching switch 1, even if this is not explicitly denoted.

Figure 3A:
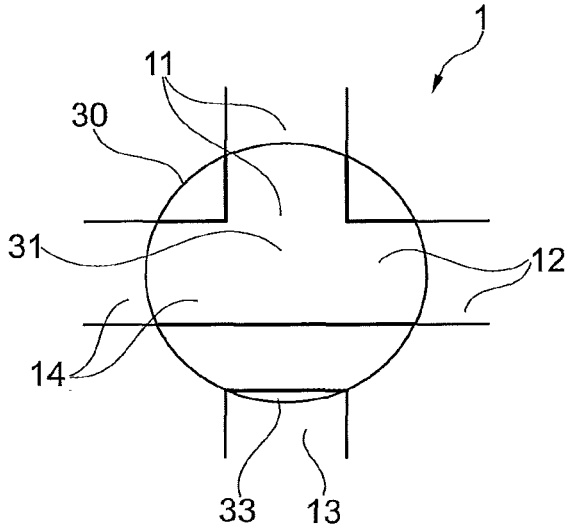
FIGS. 3A-3B schematically illustrate examples of a microwave branching switch according to embodiments of the disclosure in the second position.

FIG. 3A shows an exemplary microwave branching switch 1 in the second position. The structure of the switch 1 is similar to that illustrated in FIG. 1A except for the housing 20 not being shown. In FIG. 3A, the switching portion 30 connects the first, second and fourth transmission lines 11, 12, 14 while the third transmission line 13 is disconnected from the T-shaped junction portion 31. The disconnected transmission line 13 may be terminated into a short circuit, a load or a predetermined impedance 33 inside the switching portion 30.

Figure 3B:
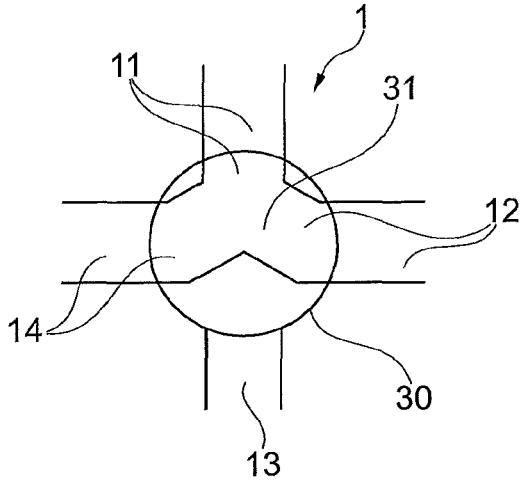

FIG. 3B shows another example of a microwave branching switch 1 in the second position. The structure of the switch 1 is similar to the switch 1 illustrated in FIG. 3A except for the shape of the junction portion 31 which in this case is Y-shaped. T- or Y-shaped junction portions 31 are preferable for connecting exactly three transmission lines.

It should be noted that the junction portion 31 might also exhibit discontinuities like posts or irises aiming at a specific impedance characteristic over the frequency band of interest, e.g. for improving the inherent matching properties of the junction portion 31 and/or the response of the overall component design.

Figure 4:
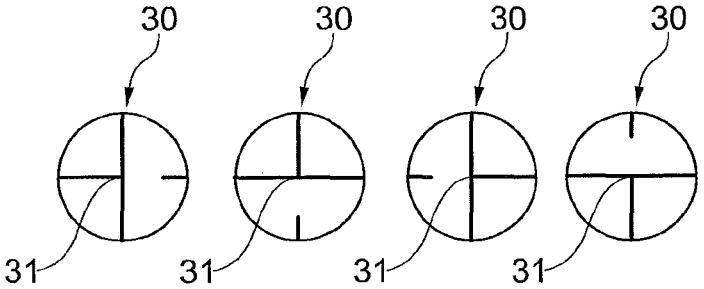
FIG. 4 schematically illustrates an example of a microwave branching switch according to embodiments of the disclosure in the first to fourth positions.
Figure 11:
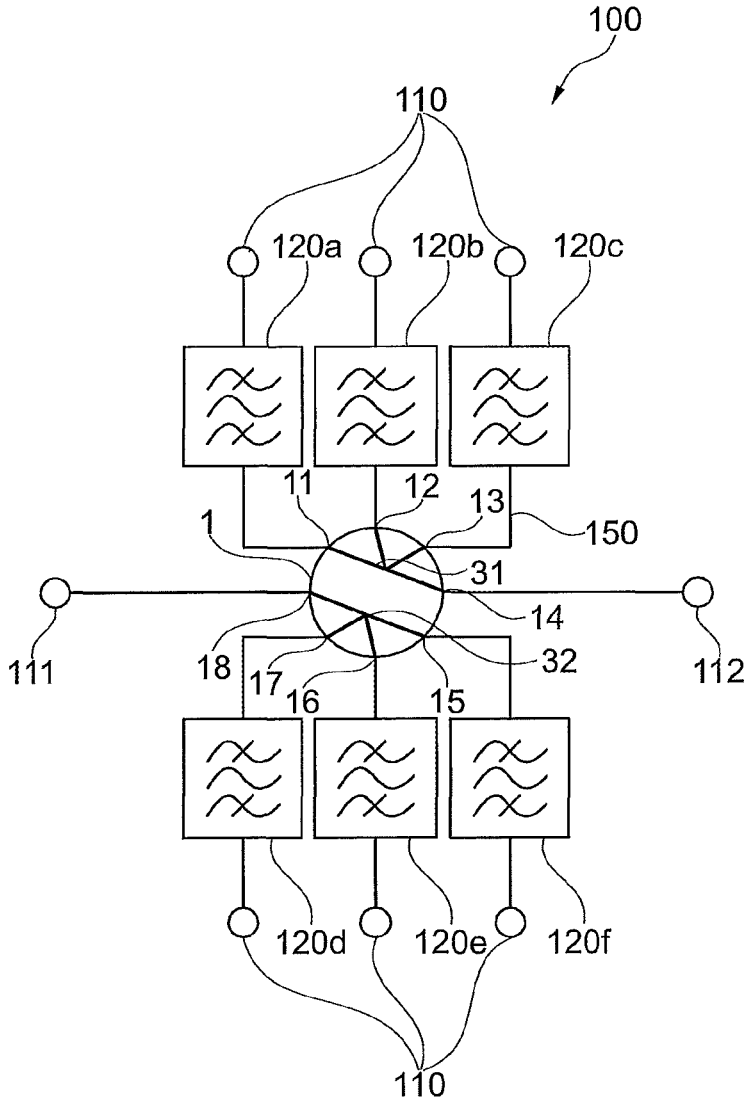
FIG. 11 schematically illustrates another example of a multiplexer according to embodiments of the disclosure.

FIG. 4 shows the available positions for a microwave branching switch 1 wherein three terminals out of four terminals 21-24 are connected by connecting three microwave transmission lines out of four microwave transmission lines 11-14 inside the switching portion 30. FIG. 4 shows only the switching portion 30. From left to right, the four available positions of the switching portion 30 are illustrated starting with the first position on the left hand side. The first, third and fourth transmission lines 11, 13, 14 are connected in the first position, the first, second and fourth transmission lines 11, 12, 14 are connected in the second position, the first, second and third transmission lines 11, 12, 13 are connected in the third position, and the second, third and fourth transmission lines 12, 13, 14 are connected in the fourth position. The switch 1 can be switched between any two adjacent positions by rotating the switching portion 30 by 90 degrees in the clockwise direction or in the counter-clockwise direction. The microwave branching switch 1 is not restricted to connecting three transmission lines or to comprising a single junction portion 31 but might also connect more than three transmission lines and/or might comprise more than one junction portion 31. A corresponding example is illustrated in FIG. 11. In this case, more than four different positions (eight different positions for the switch 1 of FIG. 11) may exist for the switching portion 30.

Figure 5B:
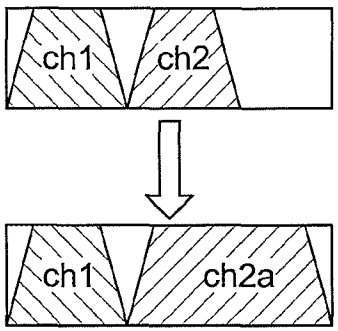
FIGS. 5A-5B schematically illustrate an example of a multiplexer according to embodiments of the disclosure.
Figure 5A:
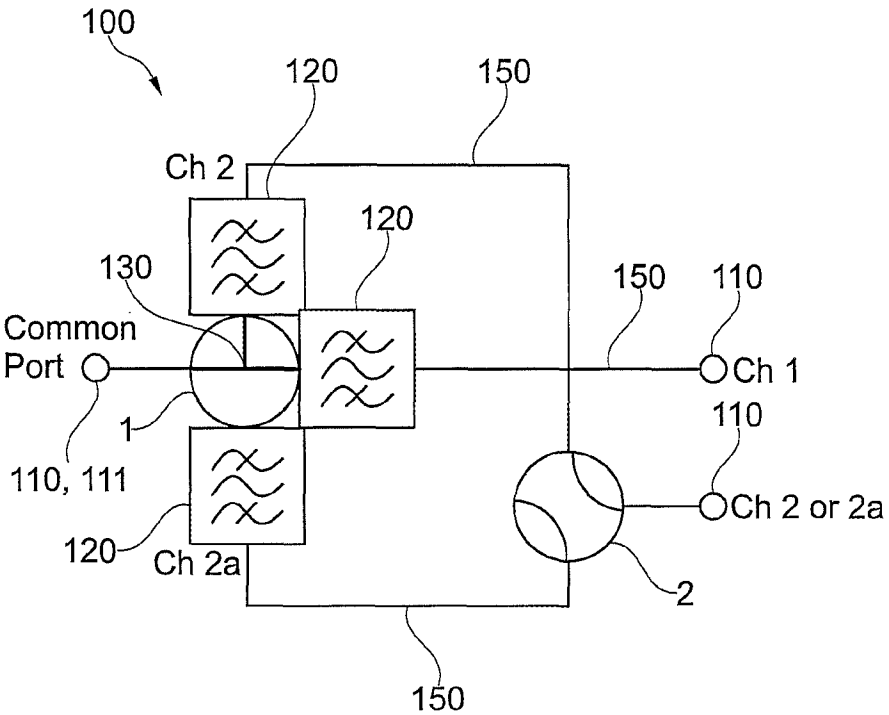

FIG. 5A shows an exemplary implementation of a microwave branching switch 1 in a multiplexer configuration. In this figure and the following figures, illustrations of the microwave branching switch 1 only show the switching portion 30 for a better overview. The multiplexer 100 comprises three signal ports 110 of which the one shown on the left is used as an input port and the ones shown on the right are used as output ports. The multiplexer 100 further comprises three signal filters 120 as bandpass filters and two switches 1, 2, of which one is a microwave branching switch 1 and the other is a conventional switch 2. Signal transmission lines 150 connect the components of the multiplexer 100.

The function of the exemplary multiplexer 100 in FIG. 5A is to provide the separation of two channels (ch1, ch2/ch2*a*) where one of the channels (ch2, ch2*a*) can be re-allocated for flexible service of different dedicated channel requirements, e.g. having an overlapping frequency range. The microwave branching switch 1 serves as the branching for the common input signal of the multiplexer 100 connecting the common (input-) port 111 with the respective channel filters (ch1, ch2/ch2*a*). FIG. 5A shows the configuration of the multiplexer 100 for serving frequency channels ch1 and ch2 that may have for example a frequency assignment according to the channel scheme depicted in FIG. 5B top.

This is, the microwave switch 1 in combination with the respective channel filters 120 (ch1, ch2) provide the separation of the respective channel signals fed to the common port 111. These are routed to the respective output ports 110 (for ch1 directly and for ch2 via the conventional switch 2). To change the channel frequency allocation of ch2 to ch2*a* for another service requirement like that shown in the scheme of FIG. 5B bottom, the switching positions of the microwave switch 1 is altered by 180° and that of the conventional switch 2 by 90°. Thus, the respective channel signal (ch1, ch2*a*) at the common port 111 for ch2*a* is now routed via the microwave switch 1, the respective channel filter 120 and the conventional switch 2 to the bottom output port 110; while the routing of the signal of ch1 is maintained via the microwave switch 1 and the respective channel filter 120 to the top output port 110 (cf. FIG. 5A).

Figure 14A:
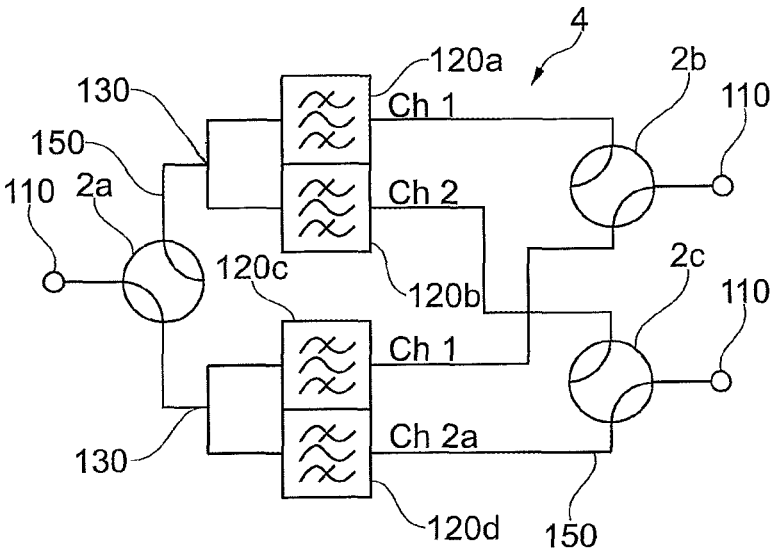
FIGS. 14A-14B schematically illustrate an example of a conventional multiplexer.
Figure 14B:
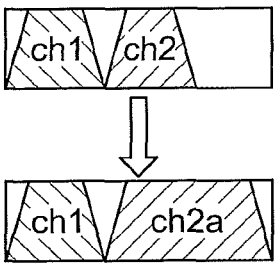

Therefore, referring to FIG. 14A, the same functionality of the multiplexer 4 of FIG. 14A is provided by the multiplexer 100 of FIG. 5A while, by implementing a microwave branching switch 1, the overall configuration is greatly simplified. Specifically, the number of necessary components is reduced (less switches 1, 2 and less transmission lines 150), and the signal filter 120 associated with the bandwidth ch1 that is to be provided at the output in any case does not need to be duplicated thanks to the branching function of the first junction portion 31 of the microwave branching switch 1.

Regarding its connection configuration, the input port in FIG. 5A differs from the output ports in FIG. 5A in that the input port is connectable to two signal filters 120 at the same time while each of the output ports is connectable to only one signal filter 120 at the same time. A signal port 110 which is connectable to more than one signal filter 120 at the same time, for example via a microwave branching switch 1 or via an (unswitchable) branching junction 130, may be called a common signal port 111, 112, 113 in the following.

Figure 6A:
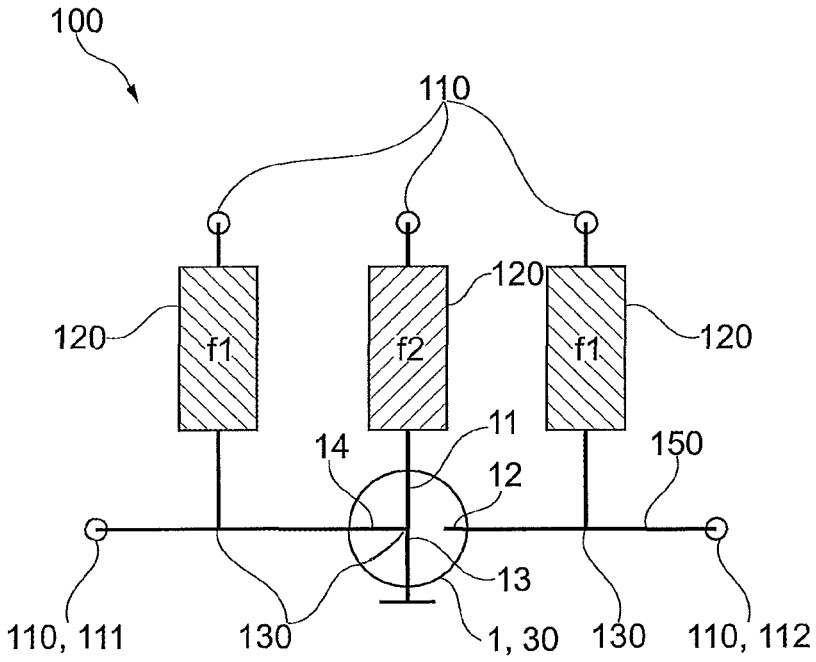
FIGS. 6A-6B schematically illustrate another example of a multiplexer according to embodiments of the disclosure.

FIG. 6A shows another example of a multiplexer 100, illustrating the capability of allocating a channel associated with a signal filter 120 to one of the common signal ports 111, 112. The multiplexer 100 comprises three signal ports 110 for inputting signals into the multiplexer 100 as well as a first common signal port 111 and a second common signal port 112 for outputting signals from the multiplexer 100. Each of the input ports is connected to a signal filter 120. Two of the signal filters 120 pass signals with a channel allocation f1 and are connected to the first common signal port 111 or the second common signal port 112 by way of fixed branching junctions 130 for providing the channel allocation f1 at both common signal ports 111, 112 independently of the switching state of the multiplexer 100. The frequency allocations of f1 served at the outputs are dedicated to different services (i.e. service areas), which allows for a frequency reuse of the channel, meaning that although they have the same frequency band, they are serving independent signals.

Figure 6B:
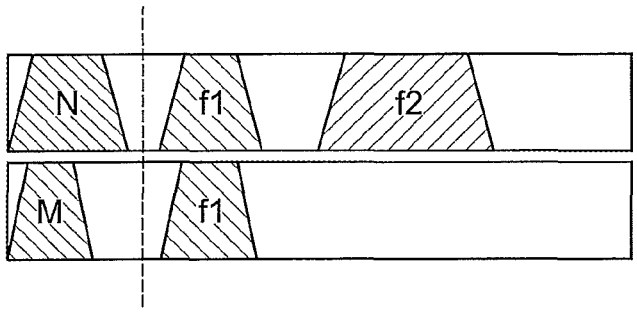

One of the input ports is connected to a signal filter 120 associated with a channel allocation f2 that is in turn connected to a microwave branching switch 1. Depending on the position of the switching portion 30 of the switch 1, a signal passing through the signal filter 120 associated with f2 is directed either to the first common signal port 111 or to the second common signal port 112. In the first case, the signals of the dedicated channel f1 (left in FIG. 6A) and channel f2 are provided at the first common signal port 111 (cf. top scheme of FIG. 6B) while the respective signals of channel f1 are provided at the second common signal port 112 (cf. bottom scheme of FIG. 6B). When changing the switch configuration by 180°, the signals of channel f1 (left in FIG. 6A) are provided at the first common signal port 111 while the channel signals of channel f1 (right in FIG. 6A) and f2 are provided at the second common signal port 112 (not shown in FIG. 6B). Therefore, the channel f2 can be allocated/combined to either common signal port 111, 112. The unused transmission line of the switch 1 (the transmission line not serving the purpose of connecting a signal filter 120 and a signal port 110; in FIG. 6A: the third transmission line 13) may be connected to a short circuit, to a load, or to any compensation circuitry, for example.

It should be noted that f1 and f2 (and f3 in some of the examples below) might also refer to power distributions instead of frequency ranges, or to any other signal characteristic that might be filtered by a signal filter 120.

Figure 7A:
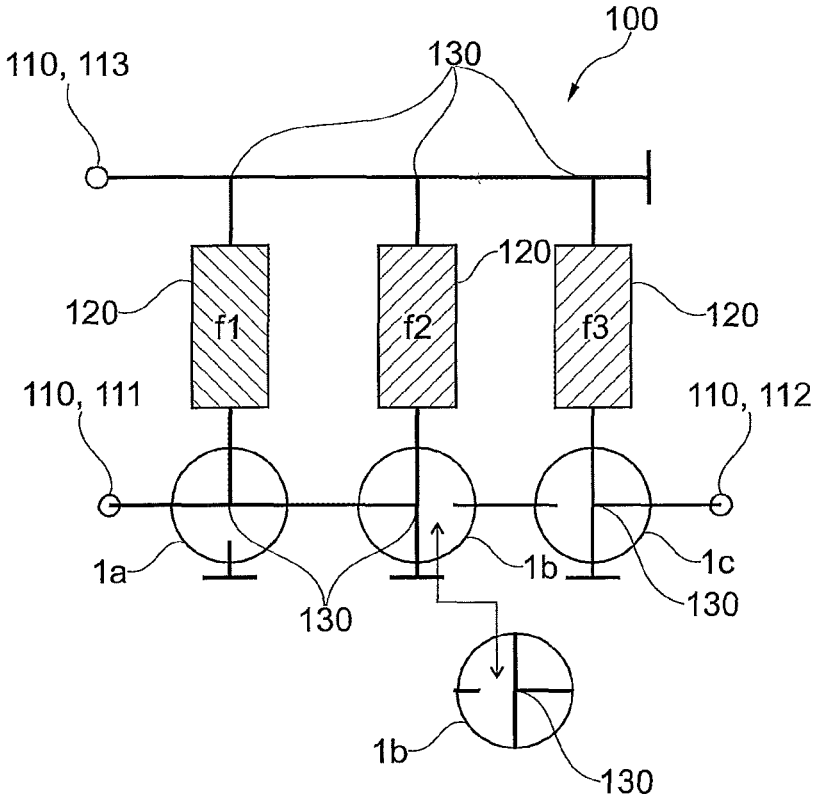
FIGS. 7A-7B schematically illustrate another example of a multiplexer according to embodiments of the disclosure.
Figure 7B:
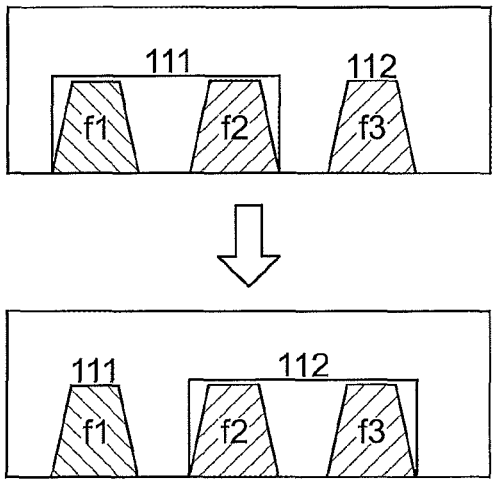

FIG. 7A shows another example of a multiplexer 100 with three common signal ports 111-113, three signal filters 120 and three microwave branching switches 1*a*-1*c*. The first and second common signal ports 111, 112 are used as output ports; the third common signal port 113 is used as an input port. With this configuration, each signal filter 120 can be selectively allocated to the first and second common signal ports 111, 112. For example, using the numbering of positions according to FIG. 4, the switch 1*a* can be set in the second position, the switch 1*b* can be set in the first position and the switch 1*c* can be set in the third position for allocating the signal filters 120 with channel allocations f1 and f2 to the first common signal port 111 and the signal filter 120 with channel allocation f3 to the second common signal port 112 (top scheme of FIG. 7B). If the switch 1*b* is switched from the first position to the third position and switch 1*c* is in the second position, the signal filter 120 serving channel f2 is disconnected from the first common signal port 111 and allocated to the second common signal port 112 (bottom scheme of FIG. 7B).

Figure 8A:
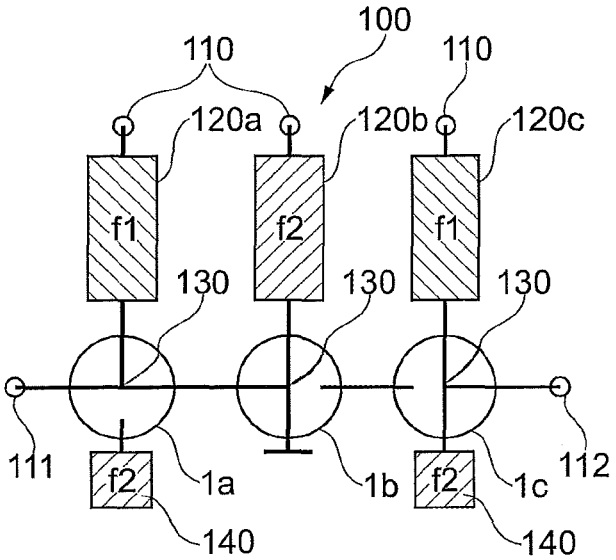
FIGS. 8A-8D schematically illustrate another example of a multiplexer according to embodiments of the disclosure.
Figure 8B:
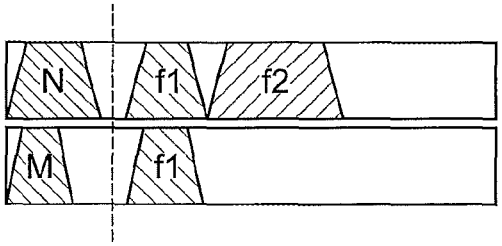
Figure 8C:
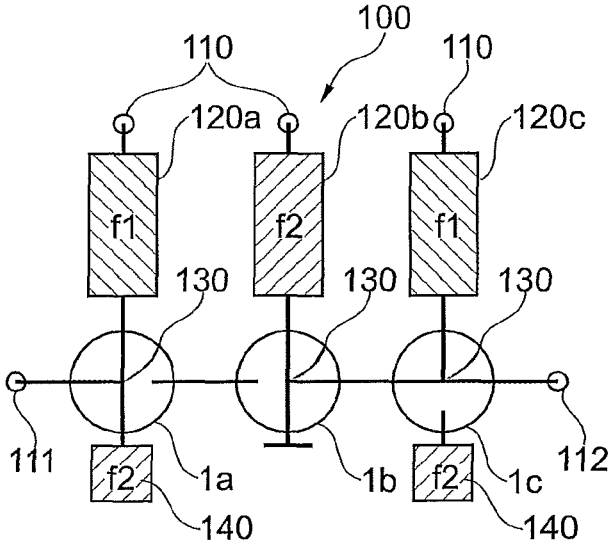

FIGS. 8A and 8C show an example of a multiplexer 100 similar to the example shown in FIG. 6A, where all branching junctions 130 are realized as microwave branching switches 1*a*-1*c*. Since f1 and f2 are contiguous frequency channels, it is preferable to provide a possibility for a selective connection of the f1 channel with a compensation circuit 140 with regard to compensating the contiguous/non-contiguous situation in cases of combining/disconnecting the adjacent channel. For example, in FIG. 8A, the channels f1+f2 are allocated to the first common signal port 111 (top scheme in FIG. 8B) and the channel f1 is allocated to the second common signal port (bottom scheme of FIG. 8B). Additionally, the signal filter 120*c* is connected to a compensation circuit 140 via the switch 1*c*.

Figure 8D:
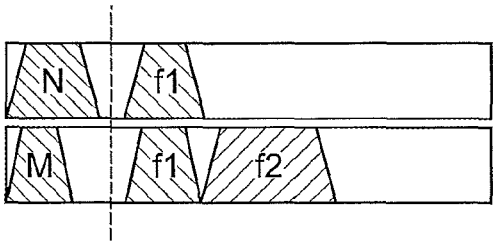

FIG. 8C shows the same multiplexer 100 with all switches 1*a*-1*c* being switched so as to provide f1 at the first common signal port 111 (top scheme of FIG. 8D) and f1+f2 at the second common signal port 112 (bottom scheme of FIG. 8D). For this configuration, the signal filter 120*c* is disconnected from the compensation circuit 140 while the signal filter 120*a* for allocating f1 to the port 111 is connected to the respective compensation circuit 140 via the switch 1*a*.

Figure 9A:
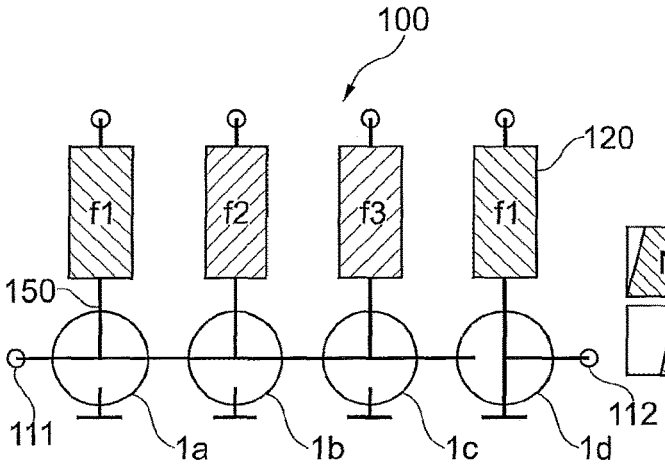
FIGS. 9A-9F schematically illustrate another example of a multiplexer according to embodiments of the disclosure.
Figure 9B:
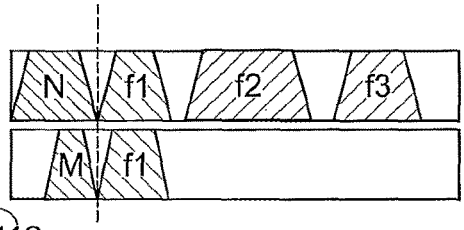
Figure 9C:
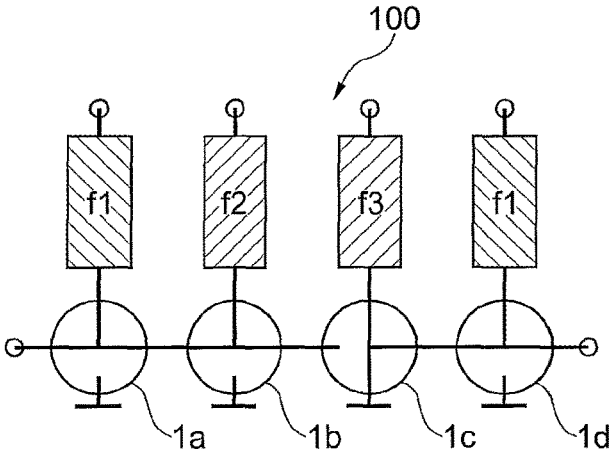
Figure 9D:
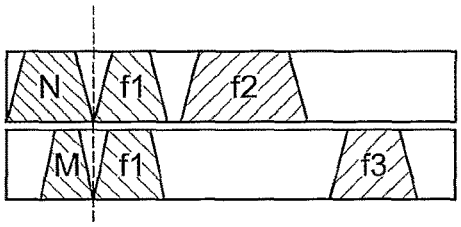
Figure 9E:
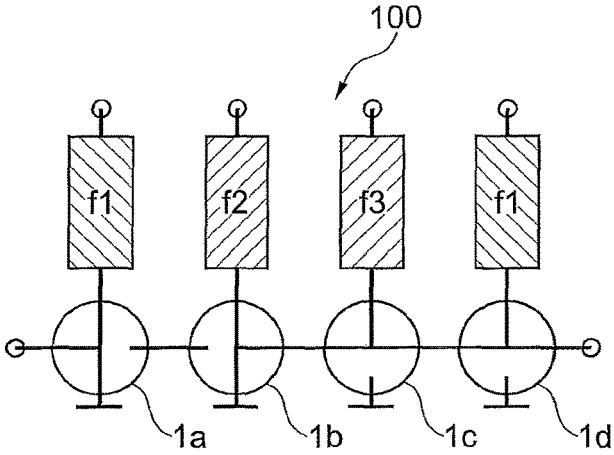
Figure 9F:
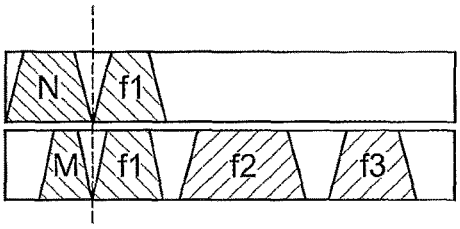
Figure 15:
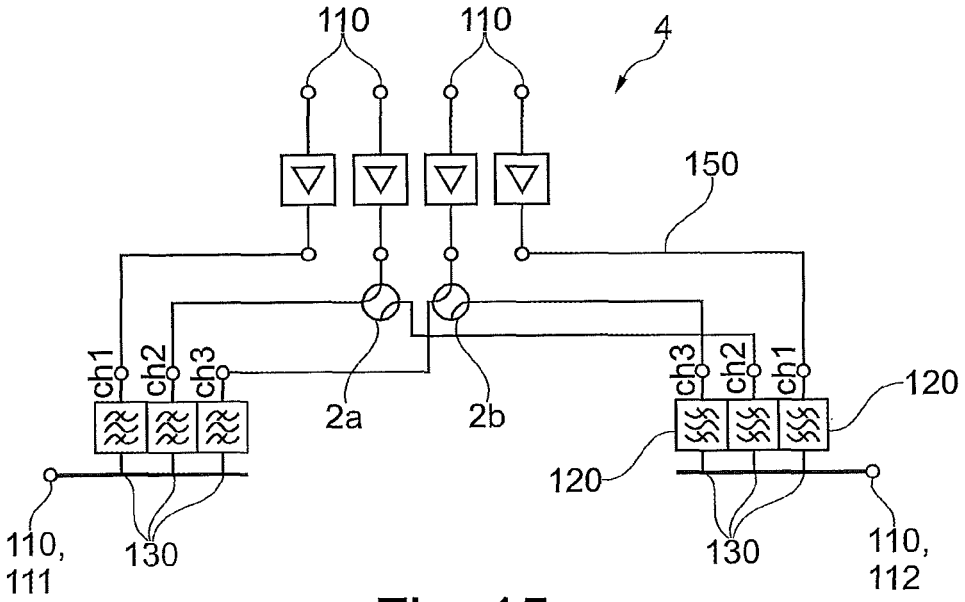
FIG. 15 schematically illustrate another example of a conventional multiplexer.

FIGS. 9A, 9C and 9E show a multiplexer 100 which serves the same purpose as the conventional multiplexer 4 in FIG. 15. That means that the channels f1 are served at both common signal ports 111, 112 (frequency reuse for different services) while f2 and f3 are selectively and independently allocated to one of the common signal ports 111, 112. Compared with the multiplexer 4 in FIG. 15, the multiplexer 100 in FIGS. 9A, 9C and 9E comprises four microwave branching switches 1*a*-1*d* instead of two conventional switches 2*a*, 2*b*, four signal filters 120 instead of six signal filters 120 and a less complicated structure of connecting transmission lines 150. In order to change the signal output as shown in FIG. 9B to an output as shown in FIG. 9D, the switch 1*c* is switched from the second position to the third position and the switch 1*d* is switched from the third position to the second position. In order to change the signal output as shown in FIG. 9D to an output as shown in FIG. 9F, switch 1*a* is switched from the second position to the first position, switch 1*b* is switched from the second position to the third position and switch 1*c* is switched from the third position to the second position.

The functional complexity of the multiplexer 100 in FIGS. 9A, 9C and 9E is therefore comparable to the complexity of the multiplexer 4 in FIG. 15, however, using microwave branching switches 1 instead of conventional switches 2 results in a considerable saving of filter hardware (4 instead of 6) and harness due to a decreased overall length of required transmission lines 150, yielding a reduction of insertion loss, complexity and mass. This is especially advantageous for applications in space, like for example in satellites.

Figure 10A:
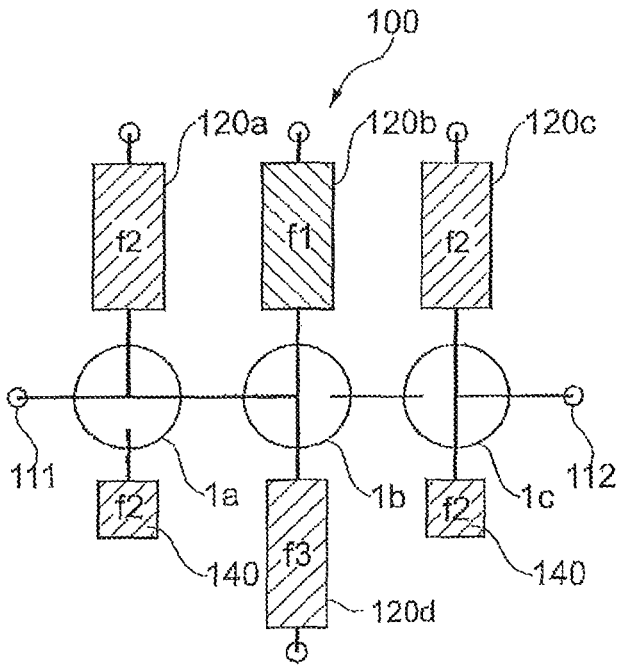
FIGS. 10A-10B schematically illustrate another example of a multiplexer according to embodiments of the disclosure.
Figure 10B:
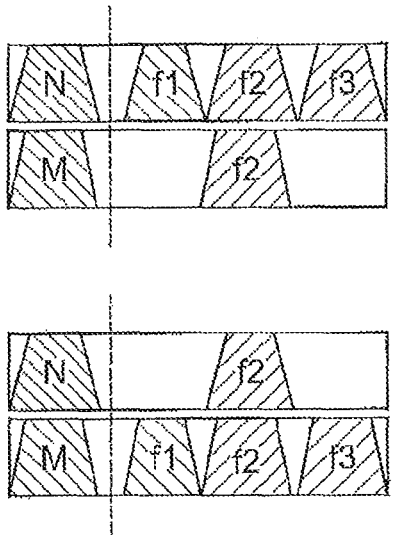

FIG. 10A illustrates a multiplexer 100 for simultaneously allocating two signal filters 120*b*, 120*d* with associated channels f1, f3 contiguous to the channel associated with the allocated signal filters 120*a*, 120*c*. All branching junctions 130 are realized as microwave branching switches 1*a*-1*c* in the multiplexer 100 in FIG. 10A; the switches 1*a* and 1*c* being connected to compensation circuits 140 similar to FIGS. 8A, 8C. The whole configuration can be switched so as to provide f1+f2+f3 at the first common signal port 111 and f2 at the second common signal port 112 (two top schemes in FIG. 10B) or so as to provide f2 at the first common signal port 111 and f1+f2+f3 at the second common signal port 112 (two bottom schemes in FIG. 10B), corresponding to a capacity re-allocation at the output ports. In this case, the switches 1*a* and 1*c* are not used for changing the allocation of signal filters 120 to common ports 111, 112 but for selectively adding compensation circuits 140 to the multiplexer circuit.

FIG. 11 shows a further example of a multiplexer 100 comprising a further example of a microwave branching switch 1. The microwave branching switch 1 comprises a switching portion 30 with a first junction portion 31 interconnecting four terminals 21-24 by interconnecting four microwave transmission lines 11-14 and a second junction portion 32 interconnecting four terminals 25-28 by interconnecting four microwave transmission lines 15-18. In the shown position of the switching portion 30, signal transmission lines 150 connecting three signal filters 120*a*-120*c* to the switch 1 are interconnected in the connection point of the first junction portion 31 such that signals transmitted by filters 120*a*-120*c* are combined and guided towards the second common signal port 112 via the transmission line 14. Furthermore, signal transmission lines 150 connecting three signal filters 120*d*-120*f* to the switch 1 are interconnected in the connection point of the second junction portion 32 such that signals transmitted by filters 120*d*-120*f* are combined and guided towards the first common signal port 111 via the transmission line 18. The switch 1 is switched to the next position by a clockwise (or counter-clockwise) rotation of the switching portion 30 by 45 degrees. In total, eight different positions are available for the switching portion 30. Thereby, a group of three signal filters 120 can be allocated to one signal port 110 while another group of three signal filters 120 can be allocated to another signal port 110, isolated from the first group.

Figure 12:
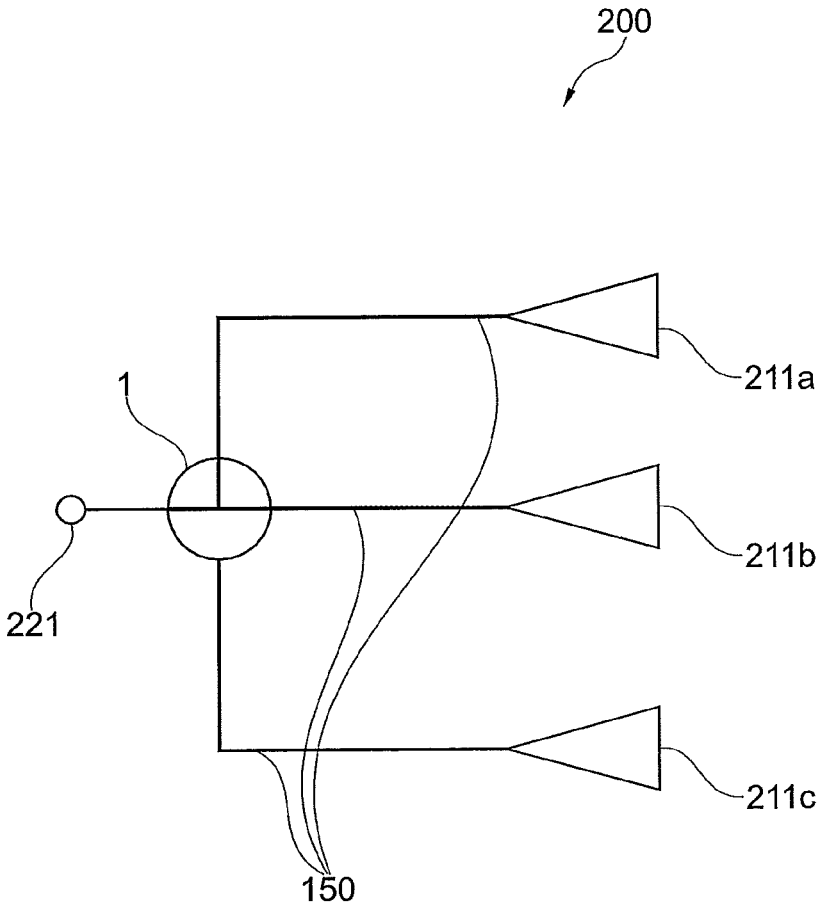
FIG. 12 schematically illustrates an example of a switchable power divider according to embodiments of the disclosure.
Figure 13:
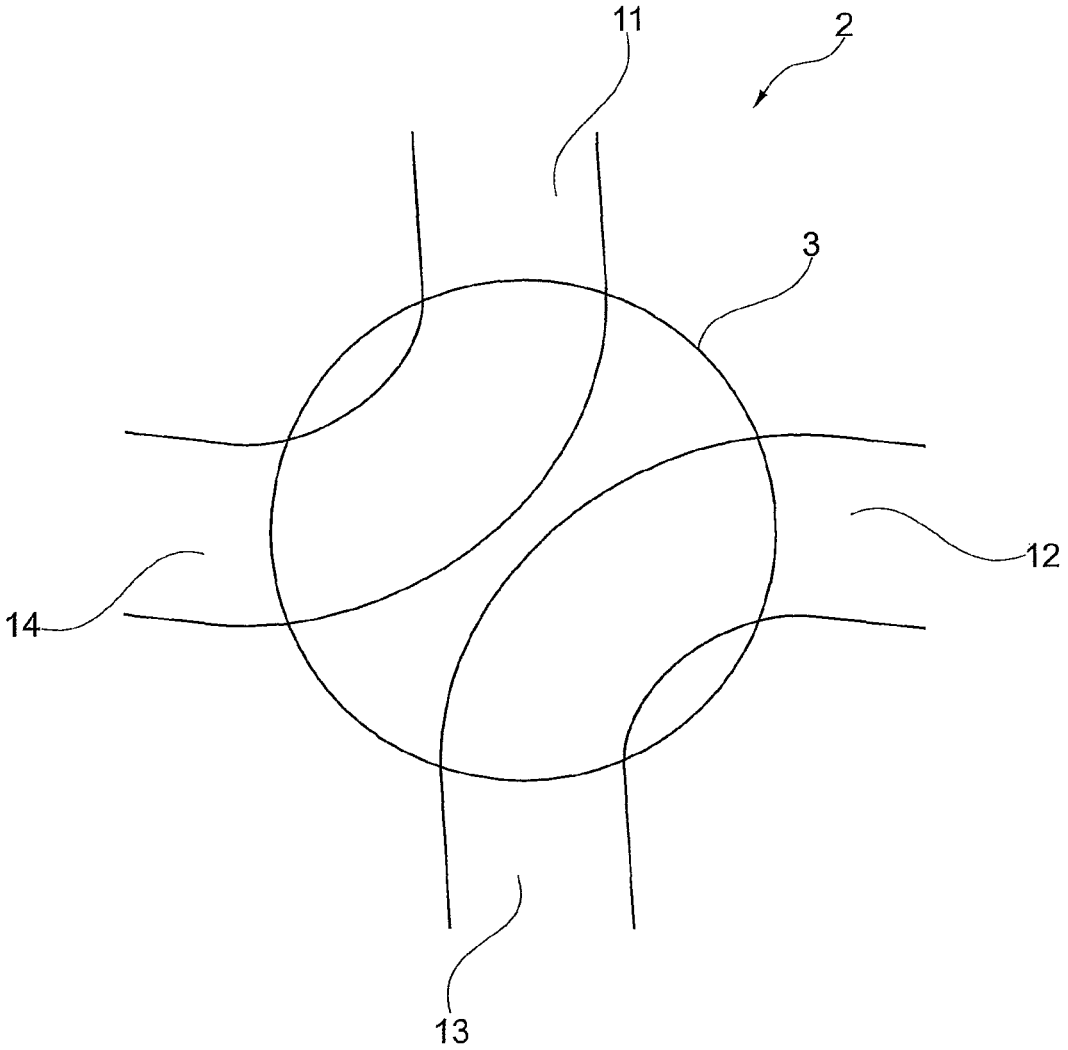
FIG. 13 schematically illustrates an example of a conventional waveguide switch.

FIG. 12 illustrates a switchable power divider 200 e.g. for feeding three antenna beams 211*a*-211*c*, a microwave branching switch 1, a common port 221 and connecting signal transmission lines 150. The power divider 200 enables a selective power distribution at the common port 221.

For example, if the switch 1 is in the second position (as shown), the power available at the common port 221 corresponds to the combined power of feeds 211*a* and 211*b*. If the switch 1 is in the fourth position, the power available at the common port 221 corresponds to the combined power of antenna beams 211*b* and 211*c*. If the switch 1 is in the first position, the power available at the common port 221 corresponds to the combined power of antenna beams 211*a* and 211*c*.

It should be noted that the description and drawings merely illustrate the principles of the proposed apparatus. Those skilled in the art will be able to implement various arrangements that, although not explicitly described or shown herein, embody the principles of the invention and are included within its spirit and scope. Furthermore, all examples and embodiments outlined in the present document are expressly intended to be for explanatory purposes only to help the reader understand the principles of the proposed apparatus. Furthermore, all statements herein providing principles, aspects, and embodiments of the invention, as well as specific examples thereof, are intended to encompass equivalents thereof.

LIST OF REFERENCE NUMERALS

1, 1*a*-1*d* microwave branching switch
2, 2*a*-2*c* conventional switch
3 conventional switching portion
4 conventional multiplexer
11 first microwave transmission line
12 second microwave transmission line
13 third microwave transmission line
14 fourth microwave transmission line
15-18 fifth to eighth microwave transmission lines
111, 121,
131, 141 inner conductors
112, 122,
132, 142 outer conductors
20 housing
21 first terminal
22 second terminal
23 third terminal
24 fourth terminal
25-28 fifth to eighth terminals
30 switching portion
31 first junction portion
32 second junction portion
33 impedance, load or short circuit
40 actuator
100 multiplexer
110 signal port
111 first common signal port
112 second common signal port
113 third common signal port
120,
120*a*-120*f* signal filter
130 branching junction
140 compensation circuit
150 signal transmission line
200 power divider
211,
211*a*-211*c* antenna beam
221 common port

The invention claimed is:

1. A microwave branching switch, comprising:

a plurality of microwave transmission lines and a plurality of terminals, each of the plurality of microwave transmission lines having a respective terminal from the plurality of terminals, the plurality of microwave transmission lines including at least a first microwave transmission line with a first terminal, a second microwave transmission line with a second terminal, a third microwave transmission line with a third terminal and a fourth microwave transmission line with a fourth terminal;

a housing in which the plurality of terminals of the plurality of microwave transmission lines are arranged;

a switching portion being switchable between at least a first position and a second position, the switching portion comprising at least a first junction portion for selectively interconnecting terminals of the plurality of microwave transmission lines by selectively interconnecting the respective microwave transmission lines;

wherein:

the switching portion with at least the first junction portion is dimensioned and positioned inside the housing in dependence of an arrangement of the plurality of microwave transmission lines such that the first junction interconnects a first group of terminals of the plurality of microwave transmission lines when the switching portion is in the first position and interconnects a second group of terminals of the plurality of microwave transmission lines when the switching portion is in the second position, wherein the first group of terminals and the second group of terminals differ in at least one terminal of the plurality of microwave transmission lines and at least one of the first group of terminals or the second group of terminals comprises the first terminal, the third terminal and the fourth terminal;

wherein at least another terminal of the plurality of terminals is disconnected from the plurality of microwave transmission lines, the at least another terminal comprising a portion that is positioned inside the switching portion and is terminated by an impedance, a load, or a short circuit.

2. The microwave branching switch according to claim 1, wherein the second terminal is disconnected from the first junction portion when the switching portion is in the first position; and either the first terminal or the third terminal or the fourth terminal is disconnected from the first junction portion when the switching portion is in the second position.

3. The microwave branching switch according to claim 1, wherein the first junction portion is T-shaped or Y-shaped.

4. The microwave branching switch according to claim 1, wherein the plurality of microwave transmission lines is a plurality of hollow waveguides or a plurality of coaxial lines.

5. The microwave branching switch according to claim 1, wherein the switching portion is a rotor;

the terminals of the plurality of microwave transmission lines are arranged evenly spaced in the housing; and the rotor is switched between the first position and the second position by rotating the rotor by a predetermined angle.

6. The microwave branching switch according to claim 5, wherein the rotor is switchable between the second position and a third position and between the third position and a fourth position, wherein the rotor is switched from the first position over the second position and the third position to the fourth position by rotating the rotor in a clockwise direction in steps of 90 degrees.

7. The microwave branching switch according to claim 1, wherein the switching portion comprises a second junction portion, wherein the switching portion with the first junction portion and the second junction portion is dimensioned and positioned inside the housing in dependence of the arrangement of the plurality of microwave transmission lines such that the first junction portion interconnects the first group of terminals of the plurality of microwave transmission lines and the second junction portion interconnects a third group of terminals of the plurality of microwave transmission lines when the switching portion is in the first position, and the first group of terminals and the third group of terminals are disjoint groups of terminals.

8. The microwave branching switch according to claim 7, wherein comprises four terminals of the plurality of microwave transmission lines and the third group of terminals comprises four terminals of the plurality of microwave transmission lines, and the first junction portion interconnects the four terminals of the first group of terminals when the switching portion is in the first position, and the second junction portion interconnects the four terminals of the third group of terminals when the switching portion is in the first position, and the switching portion is switched between two positions of a total of eight positions by rotating the switching portion in a clockwise direction in steps of 45 degrees.

9. A multiplexer, comprising a plurality of signal ports for inputting electromagnetic signals into the multiplexer or outputting electromagnetic signals from the multiplexer;

a plurality of signal filters for filtering electromagnetic signals;

one or more branching junctions for combining electromagnetic signals or for distributing an electromagnetic signal;

wherein each signal filter is connectable to a signal port of the plurality of signal ports and to a branching junction of the one or more branching junctions or connectable to two branching junctions of the plurality of branching junctions;

the plurality of signal ports comprising a first common signal port that is connectable to a branching junction of the one or more branching junctions;

the one or more branching junctions comprising a microwave branching switch according to claim 1 for selectively interconnecting signal filters of the plurality of signal filters and the first common signal port.

10. The multiplexer according to claim 9, wherein the plurality of signal ports comprises a second common signal port that is connectable to a branching junction of the one or more branching junctions;

the microwave branching switch interconnects a first group of signal filters of the plurality of signal filters and the first common signal port when the switching portion of the microwave branching switch is in the first position and the microwave branching switch interconnects a second group of signal filters of the plurality of signal filters and the second common port when the switching portion of the microwave branching switch is in the second position.

11. The multiplexer according to claim 9, further comprising a compensation circuit that is connectable to a terminal of the plurality of microwave transmission lines of the microwave branching switch for providing a predetermined impedance at the terminal.

12. The multiplexer according to claim 11, wherein each junction portion in the multiplexer is directly connected to one signal filter of the plurality of signal filters for interconnecting the one signal filter and either the first common signal port or the second common signal port.

13. The multiplexer according to claim 11, wherein at least one junction portion in the multiplexer is directly connected to at least two signal filters of the plurality of signal filters for simultaneously interconnecting the at least two signal filters and either the first common signal port or the second common signal port.

14. A switchable power divider for a beam forming network, comprising at least three antenna beams;

a common port; and a microwave branching switch according to claim 1 for selectively interconnecting antenna beams of the at least three antenna beams and the common port, wherein the microwave transmission lines of the microwave branching switch differ in size for providing different power levels at the terminals of the microwave branching switch.

* * * * *